US011035026B2

(12) United States Patent
Liu et al.

(10) Patent No.: US 11,035,026 B2
(45) **Date of Patent: *Jun. 15, 2021**

(54) ALUMINUM IRON SILICON ALLOYS HAVING OPTIMIZED PROPERTIES

(71) Applicant: GM Global Technology Operations LLC, Detroit, MI (US)

(72) Inventors: Zhongyi Liu, Troy, MI (US); Daad B. Haddad, Sterling Heights, MI (US); Julie A. Swartz, Commerce Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 100 days.

This patent is subject to a terminal disclaimer.

(21) Appl. No.: 16/156,265

(22) Filed: Oct. 10, 2018

(65) Prior Publication Data

US 2019/0093198 A1 Mar. 28, 2019

Related U.S. Application Data

(63) Continuation-in-part of application No. 15/715,907, filed on Sep. 26, 2017.

(51) Int. Cl.
*C22C 21/00* (2006.01)
*C22C 30/00* (2006.01)

(52) U.S. Cl.
CPC ..... *C22C 21/00* (2013.01); *C22C 30/00* (2013.01)

(58) Field of Classification Search
CPC ..... C22C 21/00; C22C 30/00
USPC ..... 420/551
See application file for complete search history.

(56) References Cited

U.S. PATENT DOCUMENTS

| | | | | |
|---|---|---|---|---|
| 5,053,085 | A | 10/1991 | Masumoto et al. | |
| 7,465,333 | B1 | 12/2008 | Halalay et al. | |
| 7,919,174 | B2 | 4/2011 | Ruokolainen et al. | |
| 8,052,224 | B2 | 11/2011 | Luo et al. | |
| 8,328,971 | B2 | 12/2012 | Kia et al. | |
| 9,657,372 | B2 * | 5/2017 | Oda | B22D 27/20 |
| 10,519,531 | B2 * | 12/2019 | Liu | B33Y 70/00 |
| 2007/0193663 | A1 | 8/2007 | Oda et al. | |
| 2009/0226755 | A1 | 9/2009 | Sigler et al. | |
| 2010/0092790 | A1 | 4/2010 | Luo et al. | |
| 2010/0290942 | A1 | 11/2010 | Becker et al. | |
| 2013/0121869 | A1 | 5/2013 | Kulkarni et al. | |
| 2014/0109895 | A1 | 4/2014 | Ren et al. | |
| 2015/0315688 | A1 | 11/2015 | Doty | |
| 2017/0136697 | A1 | 5/2017 | Kia et al. | |
| 2017/0136698 | A1 | 5/2017 | Kia et al. | |
| 2019/0093197 | A1 * | 3/2019 | Liu | C22C 1/1084 |

FOREIGN PATENT DOCUMENTS

| | | | |
|---|---|---|---|
| CN | 104364409 | A | 2/2015 |
| CN | 106191562 | A | 12/2016 |

OTHER PUBLICATIONS

NPL: Marker et al, Phase equilibria and structural investigations in the system Al—Fe—Si, Intermetallic 19 (2011) pp. 1919-1929 (Year: 2011).*

Callister Jr, Rethwisch; Fundamentals of Materials Science and Engineering: An Integrated Approach; Section 5.6 Specification of Compsition.

Final Office Action for Utility U.S. Appl. No. 15/715,907 dated Mar. 13, 2020, attached.

Seong Woo Kim, et al., "Removal of Primary Iron Rich Phase from Aluminum-silicon melt by centrifugal separation"; Overseas Foundry, vol. 10, No. 2; Mar. 2013; pp. vol. 10, No. 2, Mar. 2013; pp. 112-117.

* cited by examiner

*Primary Examiner* — Jie Yang
(74) *Attorney, Agent, or Firm* — Quinn IP Law

(57) ABSTRACT

Al—Fe—Si alloys having optimized properties through the use of additives are disclosed. In some aspects, an alloy includes aluminum in a first amount, iron in a second amount, silicon in a third amount, and an additive in a fourth amount. The additive is selected from the group consisting of a non-metal additive, a transition-metal additive, a rare-metal additive, and combinations thereof. The first amount, the second amount, the third amount, and the fourth amount produce an alloy with a stoichiometric formula $(Al_{1-x}A_x)_3Fe_2Si$ where A is the additive.

14 Claims, No Drawings

ALUMINUM IRON SILICON ALLOYS HAVING OPTIMIZED PROPERTIES

CROSS-REFERENCE TO RELATED APPLICATIONS

This application is continuation-in-part of U.S. patent application Ser. No. 15/715,907, filed Sep. 26, 2017, which is hereby incorporated by reference in its entirety.

INTRODUCTION

The disclosure relates to the field of Aluminum-Iron-Silicon ("Al—Fe—Si") alloys and, more specifically, to compositions and methods for optimizing properties of Al—Fe—Si alloys.

Steel and titanium alloys have been used in the manufacturing of vehicles. These alloys provide high-temperature strength, but they may be heavy and/or expensive. Components made of lightweight metals have been investigated in vehicle manufacturing, where continual improvement in performance and fuel economy is desirable. Some examples of lightweight metals include aluminum and/or magnesium alloys. However, requirements for mechanical performance and limitations during the formation process may dictate which alloy materials and alloying constituents are selected. For example, as alloyed components reduce density, mechanical properties such as strength, malleability, and ductility may sharply deteriorate.

SUMMARY

It is desirable to form lightweight Al—Fe—Si alloys with optimized properties. Beneficially, certain additives may be used to increase the strength of grain boundaries and the strength of individual grains (e.g., lattice strength). For example, as described herein, an Al—Fe—Si alloy including the additives boron, zirconium, chromium, and molybdenum may optimize mechanical properties and reduce formation limitations of Al—Fe—Si alloys. Beneficially, certain additives may be used to inhibit corrosion of Al—Fe—Si alloys. For example, an Al—Fe—Si alloy including a combination of chromium, molybdenum, and tungsten as described herein inhibits corrosion of the Al—Fe—Si alloy. Beneficially, certain additives may be used to increase ductility of the Al—Fe—Si alloys through twinning. For example, an Al—Fe—Si alloy including any of zinc, vanadium, copper, and molybdenum as described herein reduce formation limitations of Al—Fe—Si alloys. Beneficially, certain additives may be used to refine grain boundaries, refine grain boundaries and reduce grain size, or refine grain boundaries, reduce grain size, and inhibit corrosion. For example, an Al—Fe—Si alloy including certain non-metals disclosed herein includes refined grain boundaries. In further examples, an Al—Fe—Si alloy including certain transition metals disclosed herein includes refined grain boundaries and reduced grain size. In yet further examples, an Al—Fe—Si alloy including certain rare metals disclosed herein includes refined grain boundaries, reduced grain size, and optimized corrosion resistance.

According to aspects of the present disclosure, an alloy includes aluminum in a first amount, iron in a second amount, silicon in a third amount, and mechanical-optimizing additives. The mechanical-optimizing additives consisting of boron in a fourth amount, zirconium in a fifth amount, chromium in a sixth amount, and molybdenum in a seventh amount.

According to further aspects of the present disclosure, the fourth amount is at least twice the fifth amount.

According to further aspects of the present disclosure, the sixth amount is between about 2 percent by atom and about 6 percent by atom on a basis of all atoms in the first amount through the seventh amount.

According to further aspects of the present disclosure, the seventh amount is about 0.2 percent by atom on a basis of all atoms in the first amount through the seventh amount.

According to further aspects of the present disclosure, the first amount is between about 59 percent by atom and about 66 percent by atom on a basis of all atoms in the first amount through the seventh amount.

According to further aspects of the present disclosure, the second amount is about 24 percent by atom on a basis of all atoms in the first amount through the seventh amount.

According to further aspects of the present disclosure, the third amount is between about 9.5 percent by atom and about 15 percent by atom on a basis of all atoms in the first amount through the seventh amount.

According to aspects of the present disclosure, an alloy includes aluminum in a first amount, iron in a second amount, silicon in a third amount, and corrosion-inhibiting additives. The corrosion-inhibiting additives consist of chromium in a fourth amount, molybdenum in a fifth amount, and tungsten in a sixth amount.

According to further aspects of the present disclosure, the fifth amount is between about 0.2 percent by atom and about 2 percent by atom on a basis of all atoms in the first amount through the sixth amount.

According to further aspects of the present disclosure, the sixth amount is between about 0.2 percent by atom and about 2 percent by atom on a basis of all atoms in the first amount through the sixth amount.

According to further aspects of the present disclosure, the fourth amount is between about 2 percent by atom and about 6 percent by atom on a basis of all atoms in the first amount through the sixth amount.

According to further aspects of the present disclosure, the first amount is between about 59 percent by atom and about 66 percent by atom on a basis of all atoms in the first amount through the sixth amount.

According to further aspects of the present disclosure, second amount is about 24 percent by atom on a basis of all atoms in the first amount through the sixth amount.

According to further aspects of the present disclosure, the third amount is between about 9.5 percent by atom and about 15 percent by atom on a basis of all atoms in the first amount through the sixth amount.

According to aspects of the present disclosure, an alloy includes aluminum in a first amount, iron in a second amount, silicon in a third amount, and a twinning additive in a fourth amount. The twinning additive is configured to produce a twinned structure within the alloy. The first amount, second amount, third amount, and fourth amount produce an alloy with a stoichiometric formula $(Al_{1-x}M_x)_3Fe_2Si$ where M is the twinning additive.

According to further aspects of the present disclosure, x is between about 0.01 and about 0.1.

According to further aspects of the present disclosure, the twinning additive is selected from the group consisting of zinc, copper, vanadium, molybdenum, and combinations thereof.

According to further aspects of the present disclosure, the twinning additive is zinc.

According to further aspects of the present disclosure, the twinning additive consists of intermediate-radius atoms.

According to further aspects of the present disclosure, the twinning additive is a single element having an atomic radius of about 0.1335 nm.

According to aspects of the present disclosure, an alloy includes aluminum in a first amount, iron in a second amount, silicon in a third amount, and an additive in a fourth amount. The additive is selected from the group consisting of a non-metal additive, a transition-metal additive, a rare-metal additive, and combinations thereof. The first amount, the second amount, the third amount, and the fourth amount produce an alloy with a stoichiometric formula $(Al_{1-x}A_x)_3Fe_2Si$ where A is the additive.

According to further aspects of the present disclosure, x is between about 0.01 and about 0.1.

According to further aspects of the present disclosure, the additive is selected from the group consisting of non-metal elements in groups III to VI and combinations thereof.

According to further aspects of the present disclosure, the additive is boron, carbon, sulfur, or arsenic.

According to further aspects of the present disclosure, the additive is carbon.

According to further aspects of the present disclosure, the additive is sulfur.

According to further aspects of the present disclosure, the additive is selected from the group consisting of transition metals.

According to further aspects of the present disclosure, the additive is selected from the group consisting of nickel, copper, zinc, palladium, silver, cadmium, and combinations thereof.

According to further aspects of the present disclosure, the additive is selected from the group consisting of nickel, copper, zinc, and combinations thereof.

According to further aspects of the present disclosure, the additive is selected from the group consisting of rare metals.

According to further aspects of the present disclosure, the additive is selected from the group consisting of zirconium, niobium, hafnium, tantalum, tungsten, rutherfordium, dubnium, seaborgium, bohrium, and combinations thereof.

According to further aspects of the present disclosure, the additive is selected from the group consisting of zirconium, niobium, hafnium, tantalum, tungsten, and combinations thereof.

According to further aspects of the present disclosure, the additive is zirconium.

According to further aspects of the present disclosure, on a basis of all atoms within the alloy, the first amount is between 40 at % and 55 at %, the second amount is between 30 at % and 36 at %, the third amount is between 16 at % and 17 at %, and the fourth amount is at least 0.2 at %.

According to further aspects of the present disclosure, on a basis of all atoms within the alloy, the first amount is between 40 at % and 55 at %, the second amount is between 30 at % and 36 at %, the third amount is between 16 at % and 17 at %, and the fourth amount is between 0.5 at % and 5 at %.

According to further aspects of the present disclosure, the additive is combined with the aluminum, the iron, and the silicon using solid-state processing.

The above features and advantages and other features and advantages of the present disclosure are readily apparent from the following detailed description of the best modes for carrying out the disclosure.

DETAILED DESCRIPTION

As described herein, certain additives may be used to optimize properties of Al—Fe—Si alloys. For example, certain additives may be used to increase the strength of grain boundaries and the strength of individual grains (e.g., lattice strength), certain additives may be used to inhibit corrosion of Al—Fe—Si alloys, certain additives may be used to increase ductility of Al—Fe—Si alloys through twinning, and certain additives may be used to refine grain boundaries, refine grain boundaries and reduce grain size, or refine grain boundaries, reduce grain size, and inhibit corrosion. Beneficially, these optimizations provide for use of lightweight Al—Fe—Si alloys that reduce manufacturing burden and product investment as compared to other lightweight alloys, such as titanium alloys, and overcome manufacturing inhibitions, such as relatively lower ductility inhibiting fine-structured components.

For example, as described herein, additives including a combination of boron, zirconium, chromium, and molybdenum may optimize mechanical properties and reduce formation limitations of Al—Fe—Si alloys. Further, for example, additives including a combination of chromium, molybdenum, and tungsten as described herein inhibit corrosion of the Al—Fe—Si alloy. Yet further, for example, additives including any of zinc, vanadium, copper, and molybdenum as described herein reduce formation limitations of Al—Fe—Si alloys. Still yet further, for example, additives including certain non-metals as described herein refine grain boundaries within Al—Fe—Si alloys. Additionally, additives including certain transition metals as described herein refine grain boundaries and reduce grain size within Al—Fe—Si alloys. Also, for example, additives including certain rare metals as described herein refine grain boundaries, reduce grain size, and optimize corrosion resistance of Al—Fe—Si alloys. Advantageously, as described herein, certain additives may be used to provide more than one of these benefits to the resulting Al—Fe—Si alloy.

According to aspects of the present disclosure, mechanical properties of Al—Fe—Si alloys are improved through optimizing the strength of grain boundaries and optimizing the strength of the crystal lattice of individual grains through the addition of certain mechanical-optimizing additives. According to aspects of the present disclosure, the mechanical-optimizing additives include a combination of boron, zirconium, chromium, and molybdenum. While not being bound by theory, it is believed that the chromium and molybdenum are primarily enhancing the lattice strength of individual grains while the boron and zirconium are primarily enhancing the grain-boundary strength of the resulting Al—Fe—Si alloy.

An alloy having optimized mechanical properties includes a combination of aluminum, iron, silicon, boron, zirconium, chromium, and molybdenum. In some aspects, the alloy having optimized mechanical properties includes aluminum from about 59 atomic percent ("at %") to about 66 at % on a basis of all atoms within the alloy, iron at about 24 at % on a basis of all atoms within the alloy, silicon from about 9.5 at % to about 15 at % on a basis of all atoms within the alloy, chromium from about 2 at % to about 6 at % on a basis of all atoms within the alloy, molybdenum at about 0.2 at % on a basis of all atoms within the alloy, and boron and zirconium filling the remaining portion in a ratio of at least two atoms of boron for every atom of zirconium.

In some aspects, the alloy may include zirconium at about 0.1 at % on a basis of all atoms within the alloy, and boron in amounts greater than about 0.2 at % on a basis of all atoms within the alloy. For example, in some aspects, the amount of zirconium is about 0.1 at % and the amount of boron is about 0.24 at % on a basis of all atoms within the alloy. In some aspects, the amount of zirconium is about 0.1 at % and the amount of boron is about 0.4 at % on a basis of all atoms within the alloy. In some aspects, the amount of zirconium is about 0.1 at % and the amount of boron is about 0.6 at % on a basis of all atoms within the alloy. Beneficially, the mechanical-optimizing additives may reduce processing burden because solid-state processing may be implemented to combine the mechanical-optimizing additives into the Al—Fe—Si alloy. What is more, manufacturing of the alloy having optimized mechanical properties may be optimized by reducing or not increasing the number of processing steps because the mechanical-optimizing additives may be combined with the aluminum, iron, and silicon base metals prior to any alloying.

According to aspects of the present disclosure, corrosion of Al—Fe—Si is reduced through the addition of certain corrosion-inhibiting additives. After production, Al—Fe—Si alloys are passivated through formation of a native oxide layer on exposed surfaces. The native oxide layer grows based on the reaction rate at the interface between the alloy and native oxide layer, the rate that oxygen diffuses through the already-formed oxide, and the rate that oxygen arrives at the exterior surface of the oxide layer. As the thickness of the oxide layer increases, rate of oxygen diffusion slows and limits the overall reaction rate. Accordingly, after a period of time, the rate of oxidation approaches zero and the oxide thickness remains relatively stable. Even though oxygen diffusion is limited when the oxide thickness stabilizes, atoms such as chlorine ions may still penetrate the oxide layer and diffuse to the interface between the alloy and the oxide where the ions promote corrosion of the alloy.

Exposure of the component to water may provide an electrolyte at the exterior surface of the native oxide layer. For example, road spray in areas where the temperature approaches freezing may be particularly detrimental to the Al—Fe—Si alloy because solutions are applied to the road that inhibit formation of ice. These solutions function generally through ionic dissolution, and the ions carried in the road spray, such as chloride, will be deposited on the surfaces of Al—Fe—Si alloys that they contact.

Penetration of chlorine ions to the interface between the alloy and native oxide layer promotes pitting of the alloy, which may induce large-scale failures of the component. Pitting is particularly an issue with components like turbochargers, which have a number of intricate components because the relatively high ratio of surface area to volume exposes more of the alloy to pitting. Moreover, the number of components within a turbocharger provides areas where water may accumulate that may take a substantial amount of time to egress even after exposure to the road spray has ceased. For example, water may be drawn into spaces between wastegate pins and vanes via capillary action while removal of the water from these spaces is relatively slow even in dry conditions from lack of airflow.

In some aspects, the corrosion-inhibiting additives include a combination of chromium, molybdenum, and tungsten. While not being bound by theory, it is believed that the combination of chromium, molybdenum, and tungsten inhibits penetration of chlorine ions into the native oxide layer.

An alloy having optimized corrosion-inhibiting properties includes a combination of aluminum, iron, silicon, chromium, molybdenum, and tungsten. In some aspects, the alloy having optimized corrosion-inhibiting properties includes aluminum from about 59 at % to about 66 at % on a basis of all atoms within the alloy, iron at about 24 at % on a basis of all atoms within the alloy, silicon from about 9.5 at % to about 15 at % on a basis of all atoms within the alloy, chromium from about 2 at % to about 6 at % on a basis of all atoms within the alloy, molybdenum from about 0.2 at % to about 2 at % on a basis of all atoms within the alloy, and tungsten from about 0.2 at % to about 2 at % on a basis of all atoms within the alloy. Beneficially, the corrosion-inhibiting additives may reduce processing burden because solid-state processing may be implemented to combine the corrosion-inhibiting additives into the Al—Fe—Si alloy. What is more, manufacturing of the alloy having optimized corrosion-inhibiting properties may be optimized by reducing or not increasing the number of processing steps because the corrosion-inhibiting additives may be combined with the aluminum, iron, and silicon base metals prior to any alloying.

According to aspects of the present disclosure, mechanical properties of Al—Fe—Si alloys, such as ductility, are optimized through the addition of certain twinning additives M to produce an alloy having a twinned structure. Twinning occurs when two crystals of the same type intergrow such that there is only a slight misorientation between them. The interface of the twinned boundary is a highly symmetrical interface where atoms are shared by the two crystals at regular intervals. The interface of the twinned boundary is also a lower-energy interface than grain boundaries formed when crystals of arbitrary orientations grow together.

Al—Fe—Si alloys with an alloy of $Al_3Fe_2Si$ belong to $NiTi_2$-type structure (96 atoms per unit cell) where silicon occupies the Til sites (16 atoms per unit cell), iron occupies the Ni sites (32 atoms per unit cell), and aluminum occupies the Ti2 sites (48 atoms per unit cell).

An alloy having a twinned structure includes a combination of aluminum, iron, silicon, and a twinning additive M. In some aspects, the twinning additive M includes or is selected from the group consisting of intermediate-radius atoms configured to substitute for aluminum at desired points in the sublattice. Intermediate-radius atoms, as used herein, are atoms with an atomic radius that is less than the atomic radius of aluminum (0.143 nm), but is greater than the atomic radius of iron (0.124 nm). In some aspects, the intermediate-radius atoms are a single element having an atomic radius of about 0.1335 nm. In some aspects, the intermediate radius atoms include a group of more than one element, and the elements are selected such that the average atomic radius of the group is about 0.1335 nm.

The alloy having a twinned structure follows the stoichiometric formula $(Al_{1-x}M_x)_3Fe_2Si$ where M is the twinning additive. In some aspects, x is between about 0.01 and about 0.1. In some aspects, the twinning additive M includes any of or is selected from the group consisting of zinc, copper, vanadium, molybdenum, and combinations thereof. Zinc has an atomic radius of 0.133 nm, which is close to the average of 0.1335 nm. Vanadium has an atomic radius of 0.132 nm, copper has an atomic radius of 0.128 nm, and molybdenum has an atomic radius of 0.136 nm. In some aspects, the twinning additive M is only zinc, which provides benefits based on its particular density and atomic radius. While not being bound by theory, it is believed that any of zinc, copper, vanadium, and molybdenum improve mechanical properties, such as ductility, of Al—Fe—Si alloys by substituting for aluminum at certain points on the aluminum sublattice to increase the free volume of the crystal lattice. While not being bound by theory, it is believed that the intermediate-radius atoms of zinc, copper, vanadium, and molybdenum promote extensive twinning via the synchroshear mechanism such that there are two shears in different directions on adjacent atomic planes.

In some aspects, the alloy includes aluminum from about 40 at % to about 55 at % on a basis of all atoms within the alloy, iron at about 30 at % to about 36 at % on a basis of all atoms within the alloy, silicon from about 16 at % to about 17 at % on a basis of all atoms within the alloy, and a twinning additive greater than about 0.2 at % on a basis of all atoms within the alloy. In some aspects, the alloy includes aluminum from about 45 at % to about 49.5 at % on a basis of all atoms within the alloy, iron at about 33.3 at % on a basis of all atoms within the alloy, silicon at about 16.7 at % on a basis of all atoms within the alloy, and a twinning additive from about 0.5 at % to about 5 at % on a basis of all atoms within the alloy. Beneficially, the twinning additives M may reduce processing burden because solid-state processing may be implemented to combine the twinning additives M into the Al—Fe—Si alloy. What is more, manufacturing of the alloy having twinning properties may be optimized by reducing or not increasing the number of processing steps because the twinning additives M may be combined with the aluminum, iron, and silicon base metals prior to any alloying.

According to aspects of the present disclosure, mechanical properties of Al—Fe—Si alloys are optimized through addition of a non-metal additive N. In some aspects, the non-metal additive N includes or is selected from the group consisting of non-metallic elements from group III to group VI. In some aspects, the non-metal additive N is selected from the group consisting of boron, carbon, nitrogen, phosphorous, sulfur, arsenic, and selenium. While not being bound by theory, it is believed that any of the non-metal additives N as described herein refine grain boundaries within Al—Fe—Si alloys to thereby optimize mechanical properties of the resultant alloy.

The Al—Fe—Si alloy with the non-metal additive N follows the stoichiometric formula $(Al_{1-x}A_x)_3Fe_2Si$ where A is the non-metal additive N. In some aspects, x is between about 0.01 and about 0.1. In some aspects, the alloy includes aluminum from about 40 at % to about 55 at % on a basis of all atoms within the alloy, iron at about 30 at % to about 36 at % on a basis of all atoms within the alloy, silicon from about 16 at % to about 17 at % on a basis of all atoms within the alloy, and a non-metal additive N greater than about 0.2 at % on a basis of all atoms within the alloy. In some aspects, the alloy includes aluminum from about 45 at % to about 49.5 at % on a basis of all atoms within the alloy, iron at about 33.3 at % on a basis of all atoms within the alloy, silicon at about 16.7 at % on a basis of all atoms within the alloy, and a non-metal additive N from about 0.5 at % to about 5 at % on a basis of all atoms within the alloy.

According to aspects of the present disclosure, mechanical properties of Al—Fe—Si alloys are optimized through a transition-metal additive T. In some aspects, the transition-metal additive T includes any of or is selected from the group consisting of transition metals and combinations thereof. In some aspects, the transition metals are nickel, copper, zinc, palladium, silver, cadmium, and combinations thereof. While not being bound by theory, it is believed that any of the transition metals as described herein optimizes mechanical properties of Al—Fe—Si alloys by refining both grain boundaries and grain size.

The Al—Fe—Si alloy with the transition-metal additive T follows the stoichiometric formula $(Al_{1-x}A_x)_3Fe_2Si$ where A is the transition metal additive T. In some aspects, x is between about 0.01 and about 0.1. In some aspects, the alloy includes aluminum from about 40 at % to about 55 at % on a basis of all atoms within the alloy, iron at about 30 at % to about 36 at % on a basis of all atoms within the alloy, silicon from about 16 at % to about 17 at % on a basis of all atoms within the alloy, and a transition-metal additive T greater than about 0.2 at % on a basis of all atoms within the alloy. In some aspects, the alloy includes aluminum from about 45 at % to about 49.5 at % on a basis of all atoms within the alloy, iron at about 33.3 at % on a basis of all atoms within the alloy, silicon at about 16.7 at % on a basis of all atoms within the alloy, and a transition-metal additive T from about 0.5 at % to about 5 at % on a basis of all atoms within the alloy.

According to aspects of the present disclosure, mechanical properties and corrosion resistance of Al—Fe—Si alloys are optimized through use of a rare-metal additive R. In some aspects, the rare-metal additive R includes or is selected from the group consisting of transition metals proximate the lanthanides and actinides on the periodic table. In some aspects, the rare-metal additive R is selected from the group consisting of zirconium, niobium, hafnium, tantalum, tungsten, rutherfordium, dubnium, seaborgium, bohrium, and combinations thereof. While not being bound by theory, it is believed that any of the rare-metal additives R as described herein optimizes mechanical properties by refining grain boundaries and grain size of the resultant alloy. While also not being bound by theory, it is believed that any of the rare-metal additives R as described herein optimize corrosion resistance of the resultant alloy.

The Al—Fe—Si alloy follows the stoichiometric formula $(Al_{1-x}A_x)_3Fe_2Si$ where A is the rare-metal additive R. In some aspects, x is between about 0.01 and about 0.1. In some aspects, the alloy includes aluminum from about 40 at % to about 55 at % on a basis of all atoms within the alloy, iron at about 30 at % to about 36 at % on a basis of all atoms within the alloy, silicon from about 16 at % to about 17 at % on a basis of all atoms within the alloy, and a rare-metal additive R greater than about 0.2 at % on a basis of all atoms within the alloy. In some aspects, the alloy includes aluminum from about 45 at % to about 49.5 at % on a basis of all atoms within the alloy, iron at about 33.3 at % on a basis of all atoms within the alloy, silicon at about 16.7 at % on a basis of all atoms within the alloy, and a rare-metal additive R from about 0.5 at % to about 5 at % on a basis of all atoms within the alloy.

According to further aspects of the present disclosure, mechanical properties and/or corrosion resistance of Al—Fe—Si alloy is optimized through combinations of the non-metal additive N, the transition-metal additive T, and the rare-metal additive R. For example, a combination of a rare-metal additive R and a transition-metal additive T may provide corrosion resistance and optimized mechanical properties of the Al—Fe—Si alloy similar to those of an Al—Fe—Si alloy with higher concentrations of the rare-metal additive R while reducing cost as compared to the Al—Fe—Si alloy with only the rare-metal additive R.

Beneficially, additives described herein, such as the non-metal additive, the transition-metal additive, and/or the rare-metal additive, may reduce processing burden because solid-state processing may be implemented to combine the additives into the Al—Fe—Si alloy. What is more, manufacturing of the alloys may be optimized by reducing or not increasing the number of processing steps because the additives may be combined with the aluminum, iron, and silicon base metals prior to any alloying.

According to aspects of the present disclosure, ball milling is utilized to perform the solid-state reaction. Ball milling strikes the starting materials together energetically between rapidly moving milling media (e.g., milling balls), or between a milling medium and the wall of the milling vessel, in order to achieve atomic mixing and/or mechanical alloying.

An example of forming the alloys includes providing aluminum, iron, silicon, and any desired additives as starting materials. Each of the starting materials may be in powder form and may be elemental or alloyed materials. For example, the aluminum starting material may be elemental aluminum, aluminum alloy powders, such as aluminum and iron or aluminum and silicon, and the like. The powders may be separately added to the ball mill or may be added as combinations and subcombinations of the target alloy. While the starting elemental or alloy materials may be substantially pure, the resulting alloys may still include trace amounts (e.g., ≤5 at %) of other alloying elements.

Ball milling may be accomplished using any suitable high energy ball milling apparatus. Examples of high energy ball milling apparatuses include ball mills and attritors. Ball mills move the entire drum, tank, jar, or other milling vessel containing the milling media and the starting materials in a rotary or oscillatory motion while attritors stir the milling media and starting materials in a stationary tank with a shaft and attached arms or discs. An example of a conventional ball mill includes the SPEX SamplePrep 8000M MIXER/MILL®. The drum, tank, jar, or other milling vessel of the ball milling apparatus may be formed of stainless steel, hardened steel, tungsten carbide, alumina ceramic, zirconia ceramic, silicon nitride, agate, or another suitably hard material. In an example, the ball mill drum, tank, jar, or other milling vessel may be formed of a material that the starting materials will not stick to.

Ball milling may be accomplished with any suitable milling or grinding media, such as milling balls. The milling media may be stainless steel balls, hardened steel balls, tungsten carbide balls, alumina ceramic balls, zirconia ceramic balls, silicon nitride balls, agate balls, or another suitably hard milling medium. The milling media may include at least one small ball (having a diameter ranging from about 3 mm to about 7 mm) and at least one large ball (having a diameter ranging from about 10 mm to about 13 mm). In some aspects, the ratio of large balls to small balls is 1:2. As one example, the grinding media includes two small balls, each of which has a diameter of about 6.2 mm, and one large ball having a diameter of about 12.6 mm. The number of large and small balls, as well as the size of the balls, may be adjusted as desired. The milling media may be added to the ball mill drum, tank, jar, or other milling vessel before or after the starting materials are added.

Ball milling may be accomplished in an environment containing a non-reactive gas. In some aspects, the non-reactive gas is an inert gas, such as argon gas, helium gas, neon gas, or nitrogen gas. Oxygen-containing gases such as air may not be suitable due to the fact that these gases may readily form oxides on the surface of the starting materials, particularly if the milling is carried out at elevated temperatures.

Ball milling may be performed at a speed and for a time sufficient to generate the desired alloy. In an example, the speed of ball milling may be about 1060 cycles/minute (115 V mill) or 875 cycles/minute (230 V mill). In an example, the time for which ball milling may be performed ranges from about 8 hours to about 32 hours. The time may vary depending upon the amount of starting materials used and the amount of alloy to be formed.

In some aspects, a liquid medium is used during the ball milling. The liquid medium may be added may be added to the ball mill with the grinding media and the starting materials or may be added after either of the grinding media and the starting materials. The liquid medium may be added to prevent malleable metals such as aluminum from becoming permanently pressed against or adhered to the walls of the milling vessel. Suitable liquid media include non-oxidizing liquids. In some aspects, an anhydrous liquid medium is used. Examples of the anhydrous liquid medium include linear hydrocarbons, such as pentane, hexane, heptane, or another simple liquid hydrocarbon. Anhydrous cyclic or aromatic hydrocarbons may also be used. Anhydrous liquid media may be particularly desirable because they are devoid of oxygen atoms. Other suitable liquid media may include fluorinated solvents or stable organic solvents whose oxygen atoms will not oxidize the metal starting materials.

The use of the liquid medium may also facilitate uniform mixing and alloying among the aluminum, iron, silicon, and additives during the formation of the alloy. The liquid medium may ensure that the desired alloy is formed because starting material is not lost throughout the process and may also improve the yield of the desired alloy.

The ratio of total starting materials to liquid media may range from 1:5 to 1:10 by volume.

While the best modes for carrying out the disclosure have been described in detail, those familiar with the art to which this disclosure relates will recognize various alternative designs and embodiments for practicing the disclosure within the scope of the appended claims.

What is claimed is:

1. An alloy consisting of:

aluminum in a first amount;

iron in a second amount;

silicon in a third amount; and an additive in a fourth amount, the additive selected from the group consisting of a non-metal additive, a transition-metal additive, a rare-metal additive, and combinations thereof;

wherein the first amount, second amount, third amount, and fourth amount produce an alloy with a stoichiometric formula $(Al_{1-x}A_x)_3Fe_2Si$ where A is the additive and x is between about 0.01 and about 0.1;

wherein the additive is combined with the aluminum, the iron, and the silicon using solid-state processing.

2. The alloy of claim 1, wherein the additive is selected from the group consisting of non-metal elements in groups III to VI and combinations thereof.

3. The alloy of claim 2, wherein the additive is boron, carbon, sulfur, or arsenic.

4. The alloy of claim 2, wherein the additive is carbon.

5. The alloy of claim 2, wherein the additive is sulfur.

6. The alloy of claim 1, wherein the additive is selected from the group consisting of transition metals.

7. The alloy of claim 6, wherein the additive is selected from the group consisting of nickel, copper, zinc, palladium, silver, cadmium, and combinations thereof.

8. The alloy of claim 6, wherein the additive is selected from the group consisting of nickel, copper, zinc, and combinations thereof.

9. The alloy of claim 1, wherein the additive is selected from the group consisting of rare metals.

10. The alloy of claim 9, wherein the additive is selected from the group consisting of zirconium, niobium, hafnium, tantalum, tungsten, rutherfordium, dubnium, seaborgium, bohrium, and combinations thereof.

11. The alloy of claim 9, wherein the additive is selected from the group consisting of zirconium, niobium, hafnium, tantalum, tungsten, and combinations thereof.

12. The alloy of claim 9, wherein the additive is zirconium.

13. The alloy of claim 1, wherein, on a basis of all atoms within the alloy, the first amount is from 40 at % to 55 at %, the second amount is from 30 at % to 36 at %, the third amount is from 16 at % to 17 at %, and the fourth amount is from 0.2 at % to about 5 at %.

14. The alloy of claim 1, wherein, on a basis of all atoms within the alloy, the first amount is between 40 at % and 55 at %, the second amount is between 30 at % and 36 at %, the third amount is between 16 at % and 17 at %, and the fourth amount is between 0.5 at % and 5 at %.

* * * * *